US011421507B2

(12) United States Patent
Subahi et al.

(10) Patent No.: US 11,421,507 B2
(45) Date of Patent: Aug. 23, 2022

(54) REINFORCING WELLBORES PRIOR TO CASING AND CEMENTING

(71) Applicant: Saudi Arabian Oil Company, Dhahran (SA)

(72) Inventors: Mohammed S. Subahi, Al Khobar (SA); Nasser Al Hamraa, New Ain Dar Village (SA); Rawan Abdullah Alzowaid, Dammam (SA); Ahmed Hashim Daghistani, Dammam (SA); Mohammed Abdulaziz Alshobaian, Dhahran (SA); Moaath Awadh AlQahtani, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 91 days.

(21) Appl. No.: 17/071,744

(22) Filed: Oct. 15, 2020

(65) Prior Publication Data

US 2022/0120157 A1 Apr. 21, 2022

(51) Int. Cl.

| | |
|---|---|
| ***E21B 33/138*** | (2006.01) |
| ***E21B 41/00*** | (2006.01) |
| *E21B 17/10* | (2006.01) |

(52) U.S. Cl.

CPC ..... *E21B 33/138* (2013.01); *E21B 41/0078* (2013.01); *E21B 17/1078* (2013.01)

(58) Field of Classification Search

CPC ..... E21B 33/138; E21B 41/0078; E21B 17/1078; E21B 7/20; E21B 43/02

See application file for complete search history.

(56) References Cited

U.S. PATENT DOCUMENTS

| | | | | |
|---|---|---|---|---|
| 8,602,114 | B2 | 12/2013 | Bailey et al. | |
| 9,004,163 | B2 | 4/2015 | Tverlid | |
| 9,598,927 | B2 * | 3/2017 | Villarreal, Jr. ..... | C09K 8/805 |
| 9,765,592 | B2 | 9/2017 | Tolman et al. | |
| 2011/0132606 | A1 | 6/2011 | Demong et al. | |
| 2014/0299333 | A1 * | 10/2014 | Cook ..... | E21B 33/138 166/387 |

(Continued)

FOREIGN PATENT DOCUMENTS

| | | |
|---|---|---|
| CN | 102777139 | 11/2012 |
| DE | 102013005858 | 8/2014 |

(Continued)

OTHER PUBLICATIONS

PCT International Search Report and Written Opinion in International Appln. No. PCT/US2021/054781, dated Jan. 20, 2022, 15 pages.

*Primary Examiner* — Yong-Suk (Philip) Ro
(74) *Attorney, Agent, or Firm* — Fish & Richardson P.C.

(57) ABSTRACT

A coating reservoir defining a chamber operable retain to a liquid coating. A retractable application assembly includes a nozzle fluidically coupled to the coating reservoir. The nozzle is configured to dispense the liquid coating onto a wall of a wellbore. A spreader is proximal to the nozzle. The spreader is configured to regulate a thickness of the liquid coating dispensed by the nozzle. A flexible coating housing is positioned between the coating reservoir and the nozzle. The coating housing is configured to seal against a wall of the wellbore and seal the nozzle, spreader, and dispensed liquid coating from contamination within the wellbore.

21 Claims, 6 Drawing Sheets

(56) References Cited

U.S. PATENT DOCUMENTS

| | | | | |
|---|---|---|---|---|
| 2015/0060050 | A1* | 3/2015 | Scott | C22C 38/02<br>166/241.1 |
| 2015/0337620 | A1* | 11/2015 | Fonseca Ocampos | C09K 8/80<br>106/737 |

FOREIGN PATENT DOCUMENTS

| | | |
|---|---|---|
| FR | 2968702 | 6/2012 |
| WO | WO 03042489 | 5/2003 |
| WO | WO 2005001232 | 1/2005 |
| WO | WO 2014162278 | * 10/2014 |

* cited by examiner

REINFORCING WELLBORES PRIOR TO CASING AND CEMENTING

TECHNICAL FIELD

This disclosure relates to drilling wellbores.

BACKGROUND

While drilling wellbores, a drill bit at a distal end of a drill-string forms a bore by pulverizing parts of a geologic formation into pieces small enough to be carried by circulation fluid. The circulation fluid is circulated down the drill-string and up an annulus defined by the newly formed wellbore and the outer surface of the drill string. Different geologic formations may require different drilling parameters to successfully complete a wellbore.

SUMMARY

This disclosure describes technologies relating to reinforcing wellbores prior to casing and cementing the wellbores, for example, during drilling operations. The subject matter described herein is also applicable to openhole wellbores.

The subject matter within this disclosure includes a downhole tool with the following features. A coating reservoir defining a chamber operable retain to a liquid coating. A retractable application assembly includes a nozzle fluidically coupled to the coating reservoir. The nozzle is configured to dispense the liquid coating onto a wall of a wellbore. A spreader is proximal to the nozzle. The spreader is configured to regulate a thickness of the liquid coating dispensed by the nozzle. A flexible coating housing is positioned between the coating reservoir and the nozzle. The coating housing is configured to seal against a wall of the wellbore and seal the nozzle, spreader, and dispensed liquid coating from contamination within the wellbore.

Aspects of the example downhole tool, that can be combines with the example downhole tool alone or in combination with other aspects, include the following. The spreader comprises a wiper.

Aspects of the example downhole tool, that can be combines with the example downhole tool alone or in combination with other aspects, include the following. A controller is configured to receive a first command from a topside facility. The controller is configured to extend the retractable application assembly responsive to the received first command. The controller is configured to dispense the liquid coating responsive to the received first command.

Aspects of the example downhole tool, that can be combines with the example downhole tool alone or in combination with other aspects, include the following. The controller is further configured to receive a second command from the topside facility. The controller is further configured to cease dispensing the liquid coating responsive to the received second command. The controller is further configured to retract the retractable application assembly responsive to the received second command.

Aspects of the example downhole tool, that can be combines with the example downhole tool alone or in combination with other aspects, include the following. The controller is further configured to send a signal, indicative of an amount of coating within the coating reservoir, to the topside facility.

Aspects of the example downhole tool, that can be combines with the example downhole tool alone or in combination with other aspects, include the following. The liquid coating comprises a sealant.

Aspects of the example downhole tool, that can be combines with the example downhole tool alone or in combination with other aspects, include the following. Hydraulic arms are configured to extend and retract the retractable application assembly.

An example of the subject matter described within this disclosure is a method of stabilizing a wellbore. The method includes the following features. A coating is applied to a wall of a wellbore by a spray nozzle. The coating is spread along the wall of the wellbore at a substantially uniform thickness. The spread coating is cured. The wellbore wall is at least partially retained by the cured coating.

Aspects of the example method, that can be combines with the example method alone or in combination with other aspects, include the following. Casing is installed after curing the spread coating.

Aspects of the example method, that can be combines with the example method alone or in combination with other aspects, include the following. The wall of the wellbore comprises shale.

Aspects of the example method, that can be combines with the example method alone or in combination with other aspects, include the following. Applying, spreading, and curing the coating occur during drilling operations.

Aspects of the example method, that can be combines with the example method alone or in combination with other aspects, include the following. The spread coating is protected by a coating housing while applying and curing the coating.

Aspects of the example method, that can be combines with the example method alone or in combination with other aspects, include the following. The spray nozzle is extended from a work string by a hydraulic arm.

Aspects of the example method, that can be combines with the example method alone or in combination with other aspects, include the following. The spray nozzle is rotated by the work string while applying and spreading the coating.

Aspects of the example method, that can be combines with the example method alone or in combination with other aspects, include the following. Shocks to the work string, nozzle, or spreader are absorbed by the hydraulic arm.

Aspects of the example method, that can be combines with the example method alone or in combination with other aspects, include the following. The spray nozzle are retracted toward the work string by the hydraulic arm.

Aspects of the example method, that can be combines with the example method alone or in combination with other aspects, include the following. The work string is centralized by stabilizers or centralizers and the hydraulic arm during operations.

An example of the subject matter described within this disclosure is a downhole coating system that includes the following features. A drill bit is at a downhole end of a drill string. A coating reservoir is within the drill string. The coating reservoir defines a chamber operable to retain a liquid coating. A retractable application assembly includes a nozzle fluidically coupled to the coating reservoir. The nozzle is configured to dispense the liquid coating onto a wall of a wellbore. A spreader is proximal to the nozzle. The spreader is configured to regulate a thickness of the liquid coating dispensed by the nozzle. The flexible coating housing positioned between the coating reservoir and the nozzle. The coating housing is configured to protect the nozzle, spreader, and dispensed liquid coating from contamination within the wellbore. A hydraulic arm is attached to the drill string at a first end, and the retractable application assembly is attached at a second end. The hydraulic arm is configured to extend and retract the retractable application assembly. A controller is configured to receive a first command from a topside facility. The controller is configured to extend the retractable application assembly responsive to the received first command. The controller is configured to dispense the liquid coating responsive to the received first command. The controller is configured to receive a second command from the topside facility. The controller is configured to cease dispensing the liquid coating responsive to the received second command. The controller is configured to retract the retractable application assembly responsive to the received second command.

Aspects of the example downhole coating system, that can be combines with the example downhole coating system alone or in combination with other aspects, include the following. Stabilizers or centralizers are attached to the drill string.

Aspects of the example downhole coating system, that can be combines with the example downhole coating system alone or in combination with other aspects, include the following. The liquid coating includes a formation treatment chemical.

Aspects of the example downhole coating system, that can be combines with the example downhole coating system alone or in combination with other aspects, include the following. The spreader includes a brush.

Aspects of the example downhole coating system, that can be combines with the example downhole coating system alone or in combination with other aspects, include the following. The wellbore includes an unstable rock formation.

Particular implementations of the subject matter described in this disclosure can be implemented so as to realize one or more of the following advantages. The concepts described herein reduce the risk of contamination occurring with the traditionally used practice by providing an apparatus and method to stabilize the condition of the downhole zone. The concepts described herein reduce the amount of time a rig is needed onsite to form and complete a wellbore.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

When drilling through shale or other unstable formations, several complications can arise. For example, the drill-string can stick to the sides of the wellbore, impeding progress of the drill bit and drill string. In another example, the wellbore can collapse on the drill string. The friction from the collapsed wellbore can prevent rotation of the drill string, and may prevent the drill string from being retracted back to the surface. Such a situation requires fishing and milling tools that can add significant delay (for example, two weeks) to drilling operations. In another example, the rock within the geologic formation can swell and "pinch" the drill string, causing similar problems as a collapsed wellbore.

This disclosure relates to a downhole coating device that can be included on a drill string. The coating device contains the coating to be placed at the desired location within the wellbore. The device includes a coating emitting mechanism, a brush to evenly apply the coating, and an insulating cover to contain the coating to the desired area. The coating can include a sealant or treatment chemical that at least partially stabilizes the wellbore during drilling operations to reduce the risk of the drill string sticking in the formation, the wellbore collapsing during drilling, shale swelling during drilling, or any combination thereof.

Figure 1:
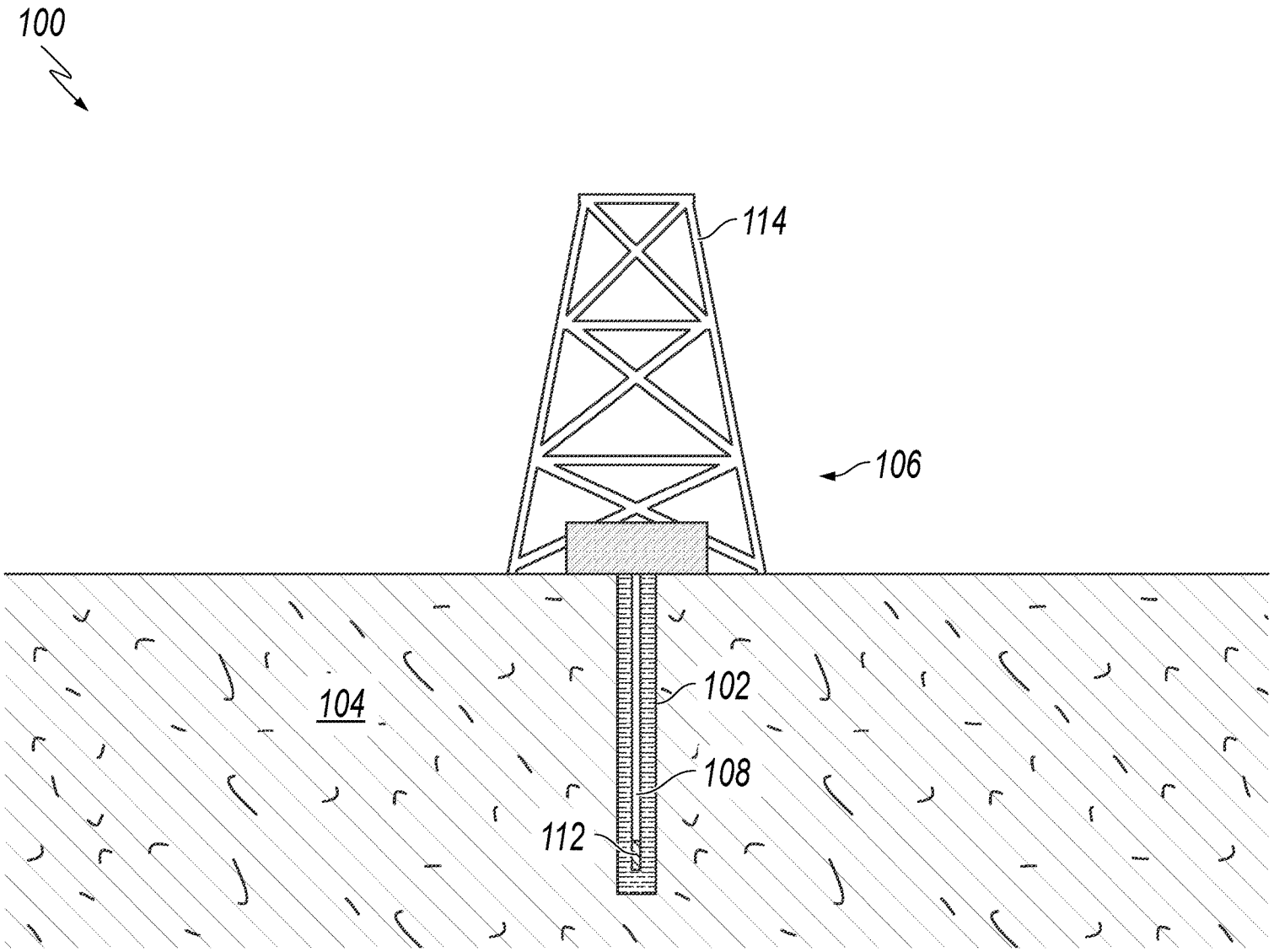
FIG. 1 is a side cross-sectional view of an example drilling site.

FIG. 1 is a side cross-sectional view of an example drilling site 100. The drilling site includes a wellbore 102 being formed in a geologic formation 104. From a topside facility 106, a drill string 108 extends into and forms the wellbore 102. As illustrated, the topside facility 106 includes a drill derrick 114 to support the drill string 108 during drilling operations; however, in some implementations, other support structures and drilling methods can be used. For example, coiled tubing drilling from a coiled tubing truck. At a downhole end of the drill string 108 is a bottom-hole assembly 112. The bottom-hole assembly 112 can include a drill bit as well as additional downhole tools. While illustrated as a vertical wellbore, wellbore 102 can include deviated sections, horizontal sections, or both, without departing from this disclosure.

Figure 2:
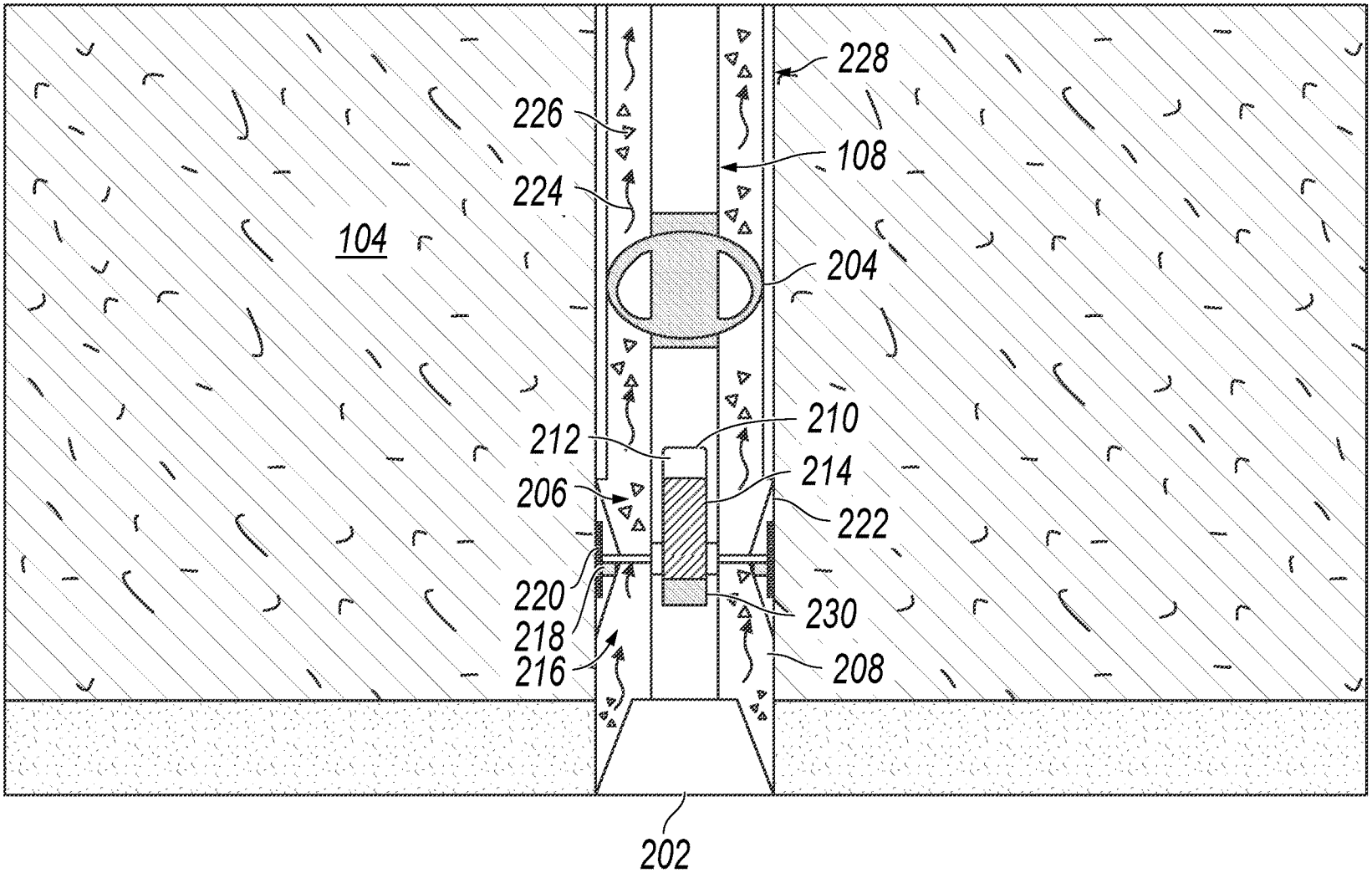
FIG. 2 is a side view of an example bottom-hole assembly within a wellbore.

FIG. 2 is a side view of an example bottom-hole assembly 112 within the wellbore 102. The bottomhole assembly 112 includes a drill bit 202 at a downhole end of the drill string 108. In some implementations, the drill string 108 includes stabilizers and/or centralizers 204 attached to the drill string 108 to assist with centralizing the drill string 108. The bottom-hole assembly 112 also includes a coating sub 206 uphole of the drill bit 202. The coating sub 206 is configured to coat the inner wall 208 of the wellbore 102 to stabilize the wellbore 102 during drilling operations. Such stabilization is useful when drilling through shale or other unstable rock formations. For the duration of this disclosure, one can assume that the wellbore 102 is being drilled through such an unstable rock formation.

The coating sub 206 includes a coating reservoir 210. The coating reservoir 210 defines a chamber 212 operable to retain a liquid coating 214. In some implementations, the liquid coating 214 includes a sealant configured to provide structural support when cured. In some implementations, the liquid coating 214 includes a formation treatment chemical that penetrates the inner wall 208 of the wellbore 102 into the geologic formation 104. In some implementations, the coating reservoir can include an elastomeric bladder to provide pressure to the liquid coating 214. The provided pressure allows the liquid coating to be transferred from the coating reservoir 210 to the rest of the coating system. In some implementations, the coating reservoir 210 can be pressurized with a pressurized gas. In such instances, the pressurized gas can pressurize the coating reservoir directly, or by applying pressure to a piston that defines a side of the coating reservoir 210. In some implementations, a pump is included in the coating sub 206 to transfer fluids from the coating reservoir 210 to the rest of the coating systems. Such a sub can be hydraulically or electrically powered. In general, the coating sub 206 can be powered in a variety of ways. For example, a battery pack can be included within the coating sub 206. In some implementations, a downhole turbine can be used to harvest power from the flow of circulation fluid. In some implementations, the coating sub 206 can include various actuable valves to direct fluid from the drill-string 108 to various operational components.

The coating sub 206 includes one or more extendable and retractable application assemblies 216. Each application assembly 216 includes a fluid nozzle 218, a spreader 220, and a flexible coating housing 222. The fluid nozzle 218 is fluidically coupled to the coating reservoir 210, for example, by a flexible hose or other conduit. The fluid nozzle 218 is configured to dispense the liquid coating 214 onto an inner wall 208 of a wellbore 102.

The spreader 220 is adjacent or proximal to the fluid nozzle 218. That is, both the spreader 220 and the fluid nozzle 218 are at a distal end of the application assembly 216. The spreader 220 is configured to regulate a thickness of the liquid coating 214 dispensed by the fluid nozzle 218. The spreader 220 can include a brush, an elastomeric wiper, or a similar application mechanism. In practice, the thickness can also be varied by adjusting operating parameters to accommodate the desired level of coating/stabilization can be controlled, for example, adjusting a rate of penetration or mud pumping rate. The flexible coating housing 222 is positioned between the coating reservoir 210 and the fluid nozzle 218. The flexible coating housing 222, along with the inner wall 208 of the wellbore, enclose the fluid nozzle 218 and spreader 220 to protect them from the wellbore fluids 224. This protection allows the liquid coating 214 to cure and solidify without being contaminated by debris 226 and wellbore fluids 224. That is, the flexible coating housing 222 covers the wet surface momentarily to allow for a desired reaction time to occur depending upon the coating or chemical used and desired level of stabilization. Once the liquid coating 214 is cured, or stabilized, it leaves a layer of cured coating 228 along the wall of the wellbore.

A controller 230 is included within coating sub 206. The controller 230 is configured to actuate the different components of the coating sub 206. In addition, the controller 230 is capable of sending and receiving commands, statuses, or both, from the topside facility 106. Details about the controller 230 are explained later within this disclosure.

Figure 3:
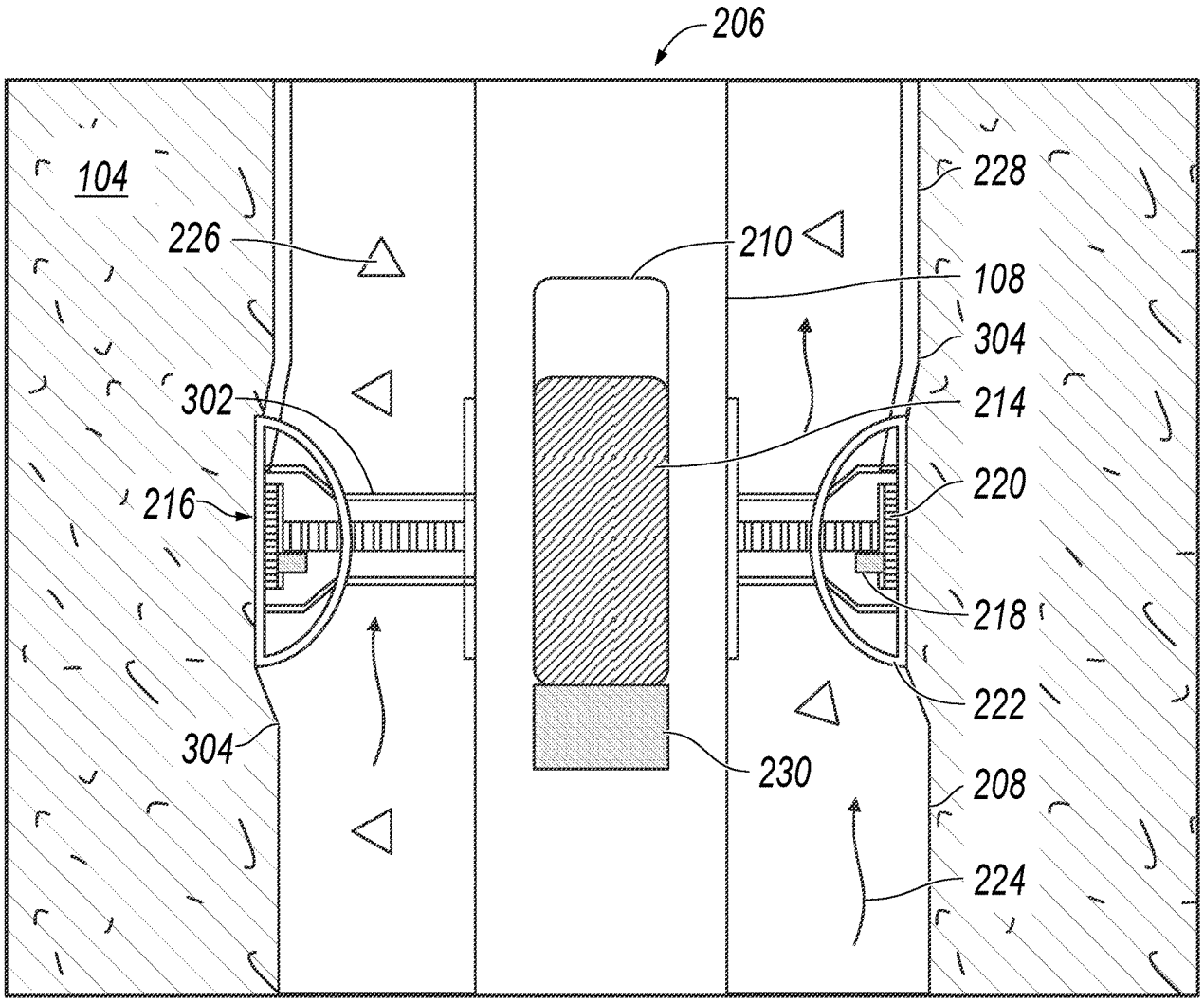
FIG. 3 is a side view of an example downhole coating tool.

FIG. 3 is a side view of an example downhole coating tool, or coating sub 206. The coating sub 206 includes one or more hydraulic arms 302, typically not always the same number as retractable application assemblies 216, are attached to the drill string 108 at a first end, and the retractable application assembly 216 at a second end, the hydraulic arm 302 is configured to extend and retract the retractable application assembly. While described primarily as a hydraulic arm, other extension mechanisms can be used without departing from this disclosure. For example, pneumatic or electric arms can be used with similar effect. In some implementations, the hydraulic arms 302 can help centralize the drill string 108. While the liquid coating 214 is being applied, the hydraulic arms 302 are configured to handle an amount of shock, or displacement caused by imperfections 304 along the inner wall 208.

Figure 4:
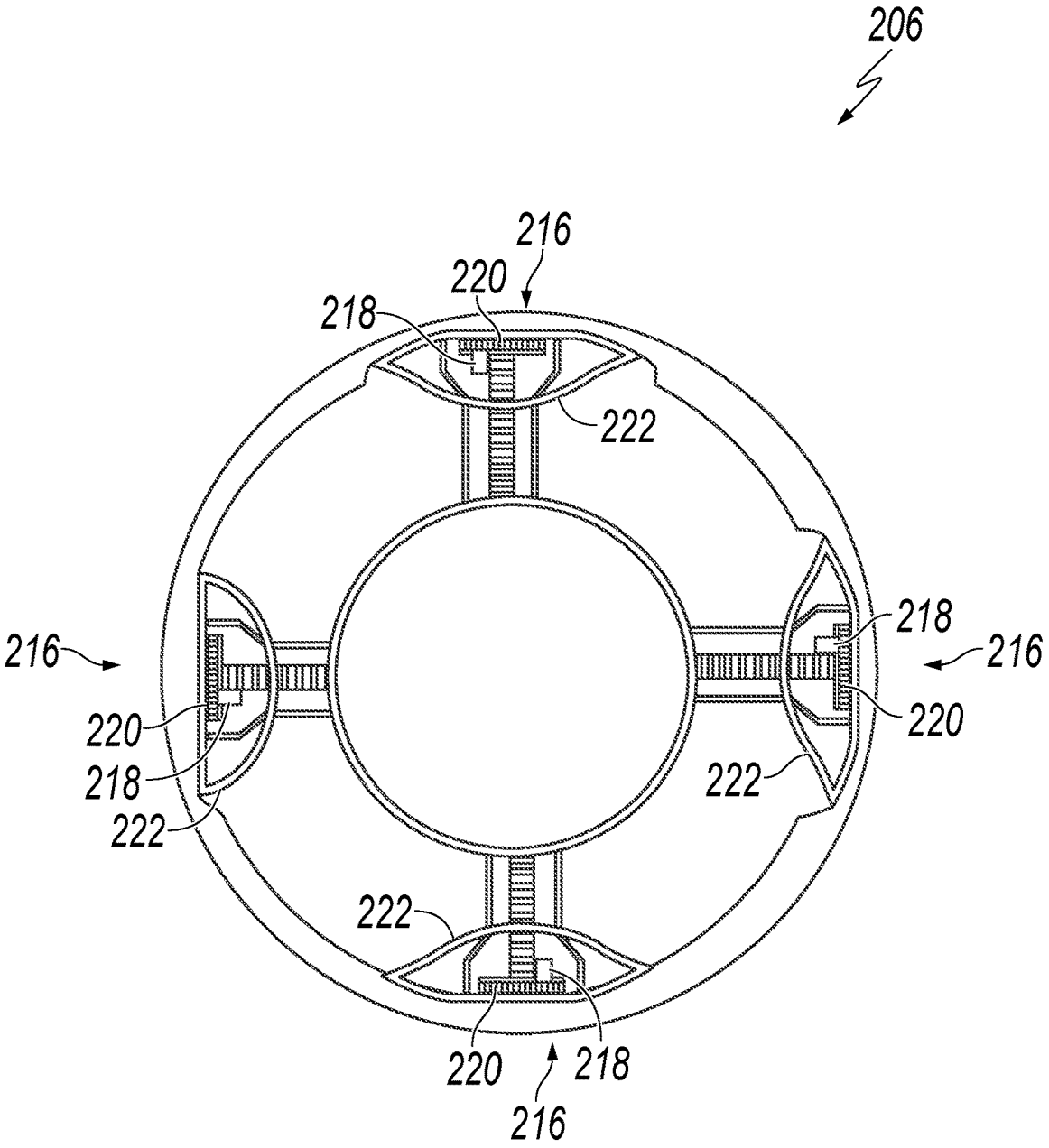
FIG. 4 is a top-down cross sectional view of the example downhole coating tool.

FIG. 4 is a top-down cross sectional view of the example downhole coating sub 206. The fluid nozzle 218 and the spreader 220 of each application assembly 216 are adjacent to one another. In practice, as the drill string 108 rotates the application assemblies 216, the fluid nozzle 218 is ahead of the spreader 220. Both the spreader 220 and the fluid nozzle 218 are substantially enclosed by the flexible coating housing 222 and the inner wall 208 of the wellbore 102 so that the liquid coating 214 can be applied evenly, without contamination from the wellbore 102, such as drilling fluid. Coating thicknesses can be adjusted either prior to application or during application. For example, the coating thickness can be between fifty and two hundred microns. While the implementations illustrated herein show two or four application assemblies 216 on the coating sub 206, greater or fewer application assemblies 216 can be used without departing from this disclosure. For example, five application assemblies 216 or three application assemblies 216 can be used.

Figure 5:
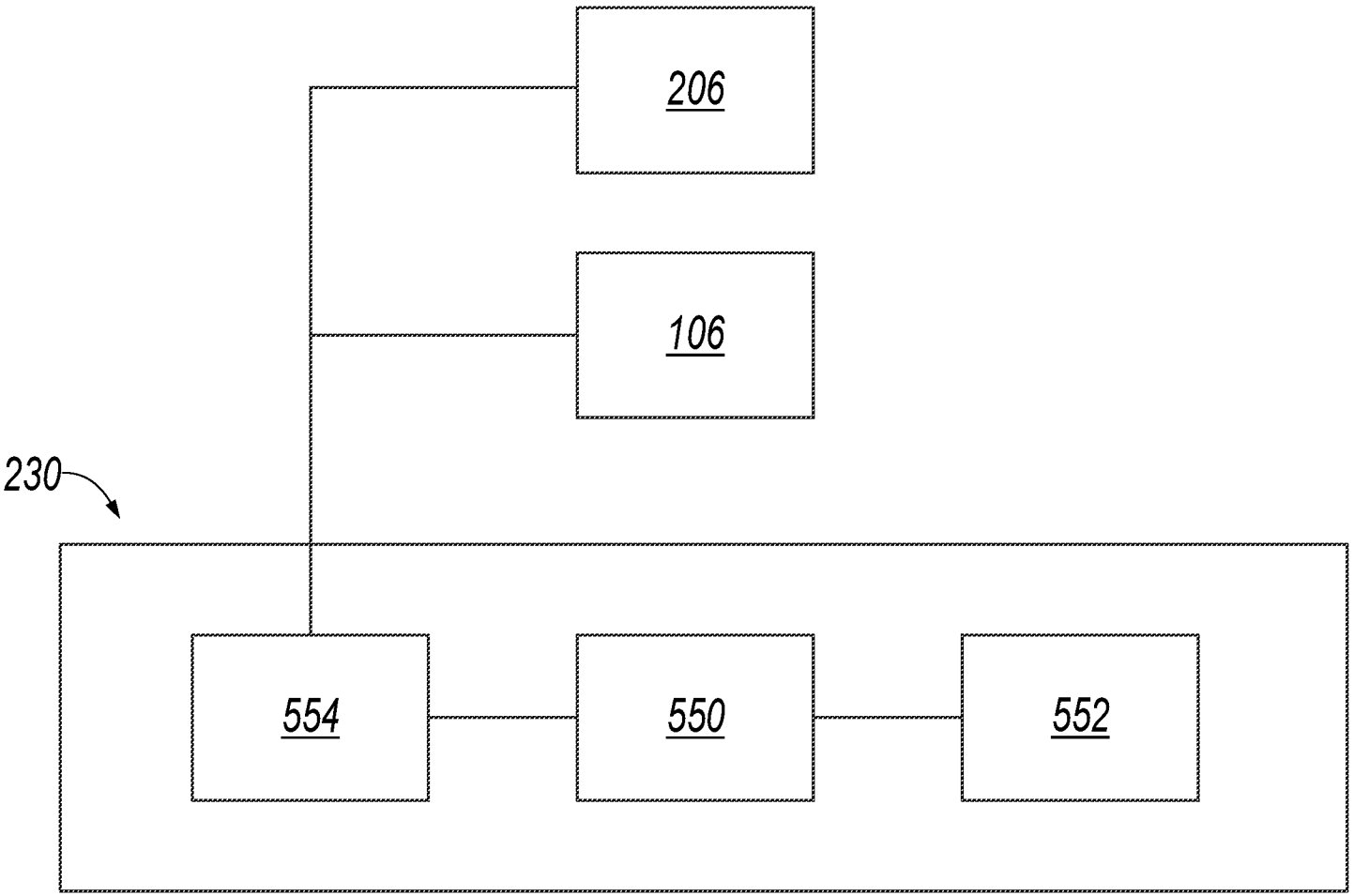
FIG. 5 is a block diagram of an example controller that can be used with aspects of this disclosure.

FIG. 5 is a block diagram of an example controller 230 that can be used within the context of this disclosure. The controller 230 can, among other things, monitor parameters of the coating sub 206 and send signals to actuate and/or adjust various operating parameters of the coating sub 206. As shown in FIG. 5, the controller 230, in certain instances, includes a processor 550 (e.g., implemented as one processor or multiple processors) and a memory 552 (e.g., implemented as one memory or multiple memories) containing instructions that cause the processors 550 to perform operations described herein. The processors 550 are coupled to an input/output (I/O) interface 554 for sending and receiving communications with components in the coating sub 206, including, for example, the hydraulic arms 302. In certain instances, the controller 230 can additionally communicate status with and send actuation and/or control signals to one or more of the various system components (including the coating reservoir 210, the fluid nozzle 218, or both) of the coating sub 206, as well as other sensors (e.g., pressure sensors, temperature sensors, vibration sensors, and other types of sensors) provided in the coating sub 206. In certain instances, the controller 230 can communicate status and send actuation and control signals to the topside facility 106. For example, the controller 230 can send a signal to the topside facility 106 indicative of an amount of available coating within the coating reservoir 210. The communications can be hard-wired, wireless or a combination of wired and wireless. In some implementations, controllers similar to the controller 230 can be located elsewhere, such as in a data van, elsewhere on a site or even remote from the site. In some implementations, the controller 230 can be a distributed controller with different portions located about a site or off site. For example, in certain instances, the controller 230 can be located downhole with the coating sub 206, or it can be located in a separate control room at the topside facility 106. Additional controllers can be used throughout the site as stand-alone controllers or networked controllers without departing from this disclosure.

The controller 230 can operate in monitoring, commanding, and using the coating sub 206 for coating the wellbore 102. To monitor and control the coating sub 206, the controller 230 is used in conjunction with various sensors. Input and output signals, including the data from the sensors, controlled and monitored by the controller 230, can be logged continuously by the controller 230.

The controller 230 can have varying levels of autonomy for controlling the coating sub 206. For example, the controller 230 can sense that the coating sub 206 is passing through a region of shale or other unstable rock formation, and an operator can activate the coating sub 206 in response. Alternatively, the controller 230 can begin sensing that the coating sub 206 is passing through a region of shale or other unstable rock formation, receive an additional input from an operator, and begin adjusting the operating parameters of the coating sub 206. Alternatively, the controller 230 can begin sensing that the coating sub 206 is passing through a region of shale or other unstable rock formation, and adjust the coating sub 206 with no input from an operator.

In operation, in some implementations, the controller 230 receives a first command from a topside facility 106. In such implementations, the controller 230 sends a command to extend the retractable application assembly 216 in response to receiving the first command. The controller 230 then sends a command to dispense the liquid coating 214 responsive to the received first command. In some implementations, the controller 230 receives a second command from the topside facility 106. In such instances, the controller 230 sends a command to cease dispensing the liquid coating 214 in response to the receiving the second command. Then, the controller 230 sends a command to retract the retractable application assembly 216 in response to the receiving the second command.

Figure 6:
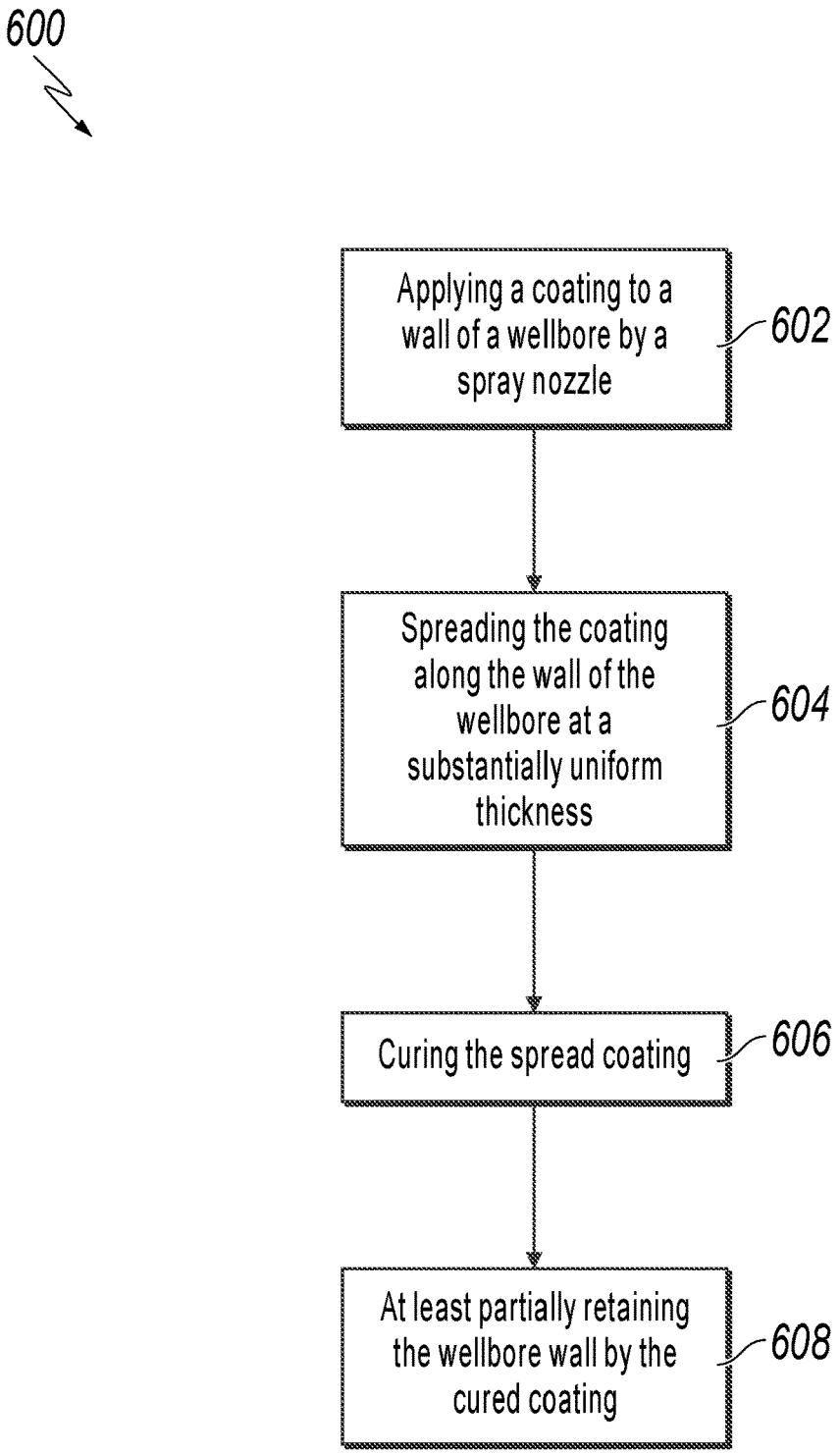
FIG. 6 is a flowchart of a method that can be used with aspects of this disclosure.

FIG. 6 is a flowchart of a method 600 that can be used with aspects of this disclosure. At 602, a coating is applied to a wall of a wellbore by a spray nozzle. In some implementations, prior to applying the coating, the spray nozzle is extended from a work string by a hydraulic arm. At 604, the coating is spread along the wall of the wellbore at a substantially uniform thickness. Applying, spreading, and curing the coating occurs during drilling operations. While applying and spreading the coating, the spray nozzle is rotated by the work string. At 606 the spread coating is cured. The coating is protected by a coating housing while applying and curing the coating. After the coating is applied, spread, and cured, the spray nozzle is retracted toward the work string by the hydraulic arm. At 608, the wellbore wall is at least partially retained by the cured coating. Such coatings are particularly useful for shale, or other unstable formations.

After the coating has cured, a casing or similar tubular can be installed within the wellbore. In some implementations, the work string is centralized within the wellbore by stabilizers and/or centralizers, the hydraulic arms, or both, during operations. In some implementations, shocks to the work string, nozzle, or spreader can be absorbed by the hydraulic arm. Such shocks can be caused by imperfections in the wall of the wellbore.

While this disclosure contains many specific implementation details, these should not be construed as limitations on the scope of any inventions or of what may be claimed, but rather as descriptions of features specific to particular implementations. For example, while primarily described and illustrated in vertical wellbores, the subject matter described throughout this disclosure is applicable to deviated and horizontal wellbores as well. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A downhole tool comprising:

a coating reservoir defining a chamber operable to retain a liquid coating;

a retractable application assembly comprising:

a nozzle fluidically coupled to the coating reservoir, the nozzle configured to dispense the liquid coating onto a wall of a wellbore;

a spreader proximal to the nozzle, the spreader configured to regulate a thickness of the liquid coating dispensed by the nozzle; and flexible coating housing positioned between the coating reservoir and the nozzle, the coating housing configured to seal against a wall of the wellbore and seal the nozzle, spreader, and dispensed liquid coating from contamination within the wellbore.

2. The downhole tool of claim 1, wherein the spreader comprises a wiper.

3. The downhole tool of claim 1, further comprising a controller configured to:

receive a first command from a topside facility;

extend the retractable application assembly responsive to the received first command; and dispense the liquid coating responsive to the received first command.

4. The downhole tool of claim 3, wherein the controller is further configured to:

receive a second command from the topside facility;

cease dispensing the liquid coating responsive to the received second command; and retract the retractable application assembly responsive to the received second command.

5. The downhole tool of claim 3, wherein the controller is further configured to:

send a signal, indicative of an amount of coating within the coating reservoir, to the topside facility.

6. The downhole tool of claim 1, wherein the liquid coating comprises a sealant.

7. The downhole tool of claim 1, further comprising hydraulic arms configured to extend and retract the retractable application assembly.

8. A method of stabilizing a wellbore comprising:

applying a coating to a wall of a wellbore by a spray nozzle;

spreading the coating along the wall of the wellbore at a substantially uniform thickness by a spreader proximal to the nozzle;

curing the spread coating;

protecting the spread coating by a flexible coating housing while applying and curing the coating, the flexible coating housing positioned between a coating reservoir and the nozzle, the coating housing configured to seal against a wall of the wellbore and seal the nozzle, spreader, and dispensed liquid coating from contamination within the wellbore; and at least partially retaining the wellbore wall by the cured coating.

9. The method of claim 8, further comprising installing casing after curing the spread coating.

10. The method of claim 8, wherein the wall of the wellbore comprises shale.

11. The method of claim 8, wherein applying, spreading, and curing the coating occur during drilling operations.

12. The method of claim 8, further comprising extending the spray nozzle from a work string by a hydraulic arm.

13. The method of claim 12, further comprising rotating the spray nozzle by the work string while applying and spreading the coating.

14. The method of claim 12, further comprising absorbing shocks to the work string, nozzle, or spreader by the hydraulic arm.

15. The method of claim 12, further comprising retracting the spray nozzle toward the work string by the hydraulic arm.

16. The method of claim 12, further comprising centralizing the work string by stabilizers or centralizers and the hydraulic arm during operations.

17. A downhole coating system comprising:

a drill string;

a drill bit at a downhole end of the drill string;

a coating reservoir within the drill string, the coating reservoir defining a chamber operable to retain a liquid coating;

a retractable application assembly comprising:

a nozzle fluidically coupled to the coating reservoir, the nozzle configured to dispense the liquid coating onto a wall of a wellbore;

a spreader proximal to the nozzle, the spreader configured to regulate a thickness of the liquid coating dispensed by the nozzle;

flexible coating housing positioned between the coating reservoir and the nozzle, the coating housing configured to protect the nozzle, spreader, and dispensed liquid coating from contamination within the wellbore; and a hydraulic arm attached to the drill string at a first end, and the retractable application assembly at a second end, the hydraulic arm configured to extend and retract the retractable application assembly; and a controller configured to:

receive a first command from a topside facility;

extend the retractable application assembly responsive to the received first command;

dispense the liquid coating responsive to the received first command;

receive a second command from the topside facility;

cease dispensing the liquid coating responsive to the received second command; and retract the retractable application assembly responsive to the received second command.

18. The downhole coating system of claim 17, further comprising stabilizers or centralizers attached to the drill string.

19. The downhole coating system of claim 17, wherein the liquid coating comprises a formation treatment chemical.

20. The downhole coating system of claim 17, wherein the spreader comprises a brush.

21. The downhole coating system of claim 17, wherein the wellbore comprises an unstable rock formation.

* * * * *